US009795267B1

(12) United States Patent
Gentile

(10) Patent No.: US 9,795,267 B1
(45) Date of Patent: Oct. 24, 2017

(54) MULTI STEP CLEANING SYSTEM

(71) Applicant: Catherine Gentile, Staten Island, NY (US)

(72) Inventor: Catherine Gentile, Staten Island, NY (US)

( * ) Notice: Subject to any disclaimer, the term of this patent is extended or adjusted under 35 U.S.C. 154(b) by 14 days.

(21) Appl. No.: 14/665,126

(22) Filed: Mar. 23, 2015

(51) Int. Cl.

| | |
|---|---|
| ***A47L 13/17*** | (2006.01) |
| ***B08B 1/00*** | (2006.01) |
| ***B08B 3/08*** | (2006.01) |
| ***C11D 11/00*** | (2006.01) |
| ***C11D 7/26*** | (2006.01) |
| ***C11D 7/32*** | (2006.01) |

(52) U.S. Cl.
CPC ..... *A47L 13/17* (2013.01); *B08B 1/006* (2013.01); *B08B 3/08* (2013.01); *C11D 7/265* (2013.01); *C11D 7/3209* (2013.01); *C11D 11/0064* (2013.01)

(58) Field of Classification Search
CPC ..... A47L 13/17; C11D 11/0064; C11D 7/265; C11D 7/3209; B08B 1/006; B08B 3/08
USPC ..... 134/6, 26, 27, 28
See application file for complete search history.

(56) References Cited

U.S. PATENT DOCUMENTS

| | | | | |
|---|---|---|---|---|
| 3,889,804 | A * | 6/1975 | Ravich | 206/221 |
| 6,814,088 | B2 * | 11/2004 | Barnabas et al. | 134/25.2 |
| 2014/0123419 | A1 * | 5/2014 | Kirk | 15/104.94 |
| 2014/0216975 | A1 * | 8/2014 | Chrysanthidis | 206/524.6 |

OTHER PUBLICATIONS

Homemade Wipes for Cleaning and Disinfecting. Internet Archived Mar. 3, 2014. <http://www.diynatural.com/homemade-wipes/>.*
Cleaning with Vinegar: Laundry, Floors, Windows and Walls, Kitchen. Internet Archived Feb. 15, 2014. <http://www.versatilevinegar.org/usesandtips.html>.*

* cited by examiner

*Primary Examiner* — Katelyn Whatley
(74) *Attorney, Agent, or Firm* — Goldstein Law Offices, P.C.

(57) ABSTRACT

A multi step cleaning system, for cleaning a cleaning surface using a first cleaning solution containing alkyl dimethyl benzyl ammonium chloride and a second cleaning solution containing acetic acid. The first cleaning solution is impregnated in a first wipe, and the second cleaning solution is impregnated in a second wipe. The wipes are sealed and provided to the user in a double chambered packet, having a first chamber and a second chamber that are isolated from each other. In use, after the packet is opened, the first wipe is used to wipe the cleaning surface, the cleaning surface is fully dried, and the second wipe is used to wipe the cleaning surface. The cleaning surface is left with an extraordinary shine that is long lasting and repels dirt, dust, and grime.

14 Claims, 6 Drawing Sheets

MULTI STEP CLEANING SYSTEM

TECHNICAL FIELD

The present disclosure relates generally to a cleaning system. More particularly, the present disclosure relates to a system that employs the separate and sequential application of two cleaning agents to provide an enhanced and unexpected cleaning result.

BACKGROUND

Many people take considerable pride in the cleanliness of their living spaces. Beyond even the motivation of having a hygienic environment, having a clean environment contributes to happiness and productivity.

To maintain an optimal state of cleanliness, a variety of cleaning products are available on the market. These cleaning products are intended for use with various cleaning applications, and have varying degrees of effectiveness. For example, certain cleaners are specified for use for different cleaning functions, such as emulsifying oils, cutting grease, disinfecting, and even providing a sheen or shine on a surface. Cleaners are also often specified by the type of surface they are best suited for, such as tile, glass, wood, metallic surfaces, etc.

While these units may be suitable for the particular purpose employed, or for general use, they would not be as suitable for the purposes of the present disclosure as disclosed hereafter.

Many household cleaners claim to serve a variety of functions, from cleaning dirt and grime, to shining an array of surfaces. Commercial cleaners come in a variety of forms and packaging including liquid chemical spray bottles and a stack of cleaning sheets packaged together and fully presaturated with the cleaning chemical. Degrees of abrasiveness can vary between brands.

Known primarily for their disinfecting properties, many of these cleaning sheets direct a user to wipe down a surface, such as glass, and leave the product wet for a set amount of time before letting it evaporate. The prolonged exposure to the abrasive chemicals, however, together with the oversaturation of the sheets, can damage the surface and can create a dullness and streakiness which the user specifically seeks to avoid. While effective in sanitizing the glass, many of these cleaning wipes include one of two active ingredients, benzalkonium, a quarternary ammonium compound whose disinfecting activity is greatly reduced in the presence of soiling matter, and hydrogen peroxide. When using a benzalkonium-based product, specifically, many brands advise thoroughly cleaning the surface before applying the cleaning wipe for best disinfecting results. Further, quarternary compounds are more effective in alkaline conditions than in acidic.

Where cleaning products fail to provide the desired results, people sometimes combine cleaning products prior to use. The results of such combinations can be toxic, dangerous, and can even damage the surface being cleaned.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a cleaning system that immediately provides an extraordinary shine, and provides dirt repellent properties for an extended time thereafter. Accordingly, the present disclosure describes a system for applying a first cleaning solution containing alkyl dimethyl benzyl ammonium chloride, and then applying a second cleaning solution containing acetic acid. The separate, sequential use of these two cleaning solutions provides an unexpectedly clean appearance and long lasting dirt repelling properties.

It is a further aspect of an example embodiment in the present disclosure to provide a cleaning system that safely employs two chemicals which are inadvisable to mix. Accordingly, the system provides a drying step after application of the first cleaning solution, and before applying the second cleaning solution.

It is a further aspect on an example embodiment in the present disclosure to provide the first and second cleaning solutions in a form that is suitable for cleaning a surface. Accordingly, a first and second wipe are provided, each consisting of a sturdy absorbent carrier. The first cleaning solution is impregnated in the first wipe, and the second cleaning solution is impregnated in the second wipe.

It is yet a further aspect of an example embodiment in the present disclosure to provide a cleaning system which conveniently avails the first and second cleaning solution for use in the prescribed mode of operation. Accordingly, the first and second wipes are provided in a double chambered packet, wherein the first and second wipes are contained in distinct chambers. The packet is opened just prior to use to give the user access to each of the chambers, and to the wipes contained therein for application according to the procedure described herein.

Accordingly, the present disclosure describes a multi step cleaning system, for cleaning a cleaning surface using a first cleaning solution containing alkyl dimethyl benzyl ammonium chloride and a second cleaning solution containing acetic acid. The first cleaning solution is impregnated in a first wipe, and the second cleaning solution is impregnated in a second wipe. The wipes are sealed and provided to the user in a double chambered packet, having a first chamber and a second chamber that are isolated from each other. In use, after the packet is opened, the first wipe is used to wipe the cleaning surface, the cleaning surface is fully dried, and the second wipe is used to wipe the cleaning surface. The cleaning surface is left with an extraordinary shine that is long lasting and repels dirt, dust, and grime.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
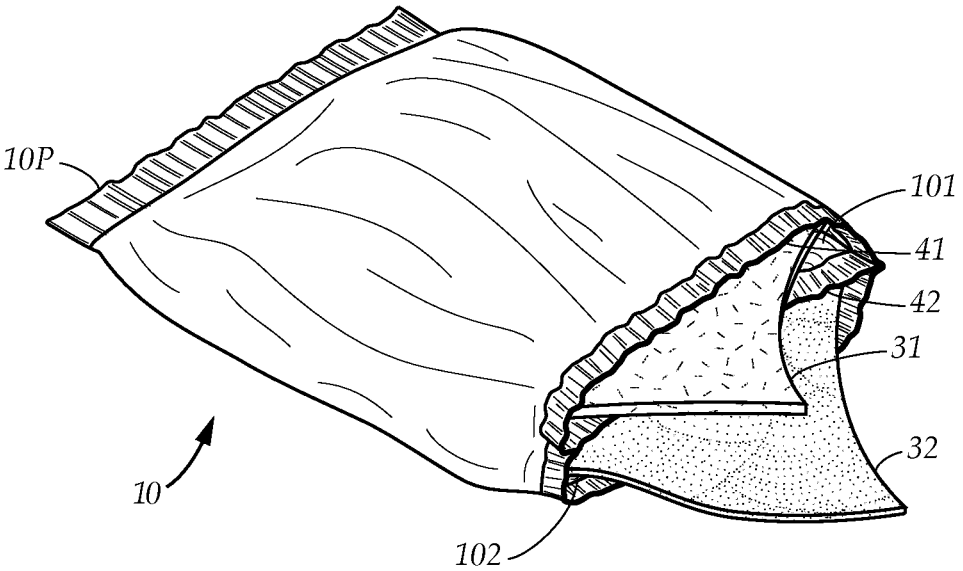
FIG. 1 illustrates a doubled chambered packet, in accordance with the present disclosure, containing a first and a second wipe.

FIG. 1 illustrates a double chambered packet 10, having a periphery 10P, a first chamber 101 containing a first wipe 31, and a second chamber 102 containing a second wipe 32. Each of the wipes 31, 32, may be generally considered to be a disposable cloth (made of synthetic materials, natural materials, or a blend thereof), that is treated with a cleansing agent (as defined below), and generally configured for wiping things clean. Each chamber 101, 102 has an opening 41, 42, wherein the wipes 31, 32 are shown protruding partially therefrom. The first wipe is impregnated, soaked, or moistened with a first cleaning solution. The first cleaning solution includes alkyl (50% C14, 40% O12, 10% C16) dimethyl benzyl ammonium chloride, an active ingredient provided in disinfecting wipes produced by LYSOL® (N-alkyl dimethyl ethylbenzyl ammonium chloride, alkyl dimethyl benzyl ammonium chloride, alkyl dimethyl ethyl benzyl ammonium chloride, butoxydiglycol, sodium metasilicate, benzalkonium chloride, tetrasodium ethylenediaminetetraacetic acid, alcohol ethoxylate (C12-15), ethanol, and water) a concentration in solution of approximately 0.25%. The second wipe is impregnated, soaked, or moistened with a second cleaning solution. The second cleaning solution comprises acetic acid and water. A preferred composition may employ acetic acid from a standard mixture of household white/distilled vinegar (3-5% acetic acid). The household vinegar is then combined with water, with 1 to 2 parts vinegar to 3 parts water, providing a general range of concentration of acetic acid of substantially 0.75% to 2.00%. Essentially then, the second cleaning solution comprises a dilution of household white/distilled vinegar.

Figure 6A:
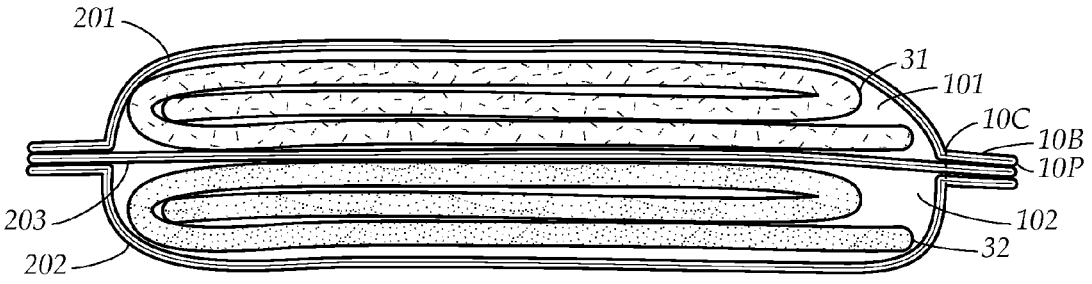
FIG. 6A is a side elevational view with parts broken away, illustrating the double chambered packet, containing the first wipe and second wipe in separate chambers, insulated from each other by a barrier wall.
Figure 6B:
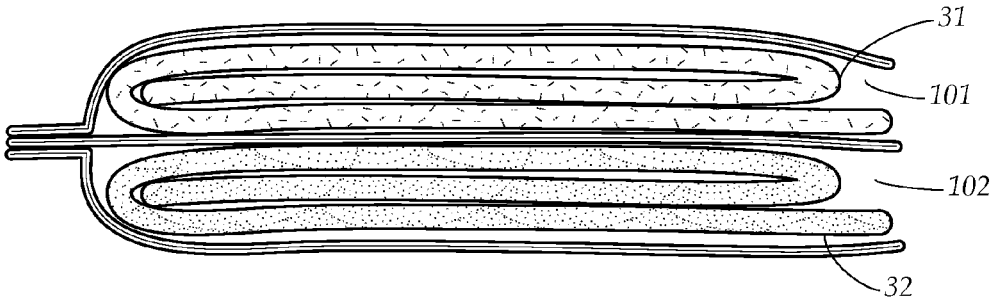
FIG. 6B is a side elevational view, similar to FIG. 6A, except wherein the double chambered packet is opened, allowing separate access to the first chamber, containing the first wipe, and the second chamber, containing the second wipe.

The packet 10 is substantially rectangular and of a convenient size. Referring to FIG. 6A, each wipe 31, 32 may be significantly larger than the packet 10, and thereby folded more than once to fit within the first chamber 101 and second chamber 102, respectively. The packet 10 has a first outer wall 201, a second outer wall 202, and a barrier wall 203 extending therebetween. Note that the first outer wall 201 is generally sealed along the periphery 10P to the barrier wall 203, thereby defining the first chamber 101 and enclosing the first wipe 31 therein; and the second outer wall 202 is generally sealed along the periphery 10P to the barrier wall 203, thereby defining the second chamber 102 and enclosing the second wipe 32 therein. Note that when the outer walls 201, 202 and barrier wall 203 are sealed together, a border region 10B is created near the periphery. If the packet is torn such that the border region 10B is removed, simultaneous access may thereby provided to the first chamber 101 and second chamber 102, and to the first wipe 31, and second wipe 32, contained therein, as seen in FIG. 6B. To facilitate tearing of the border region 10B, the border region may have an opening adaptation 10C adjacent to the chambers 101, 102, and opposite from the periphery 10B. The opening adaptation allows the packet 10 to be easily opened to provide access to the chambers 101, 102 by tearing away the border from the remainder of the packet. The adaptation opening may include a perforation, a scoring or necking that weakens the material and facilitates tearing, a pull tab, or any adaptation that allows the outer walls 201, 202 and barrier wall 203 to be torn therealong when desired, yet maintains effective sealing of the first chamber 101 and the second chamber 102 from each other and from the ambient environment.

Figure 2:
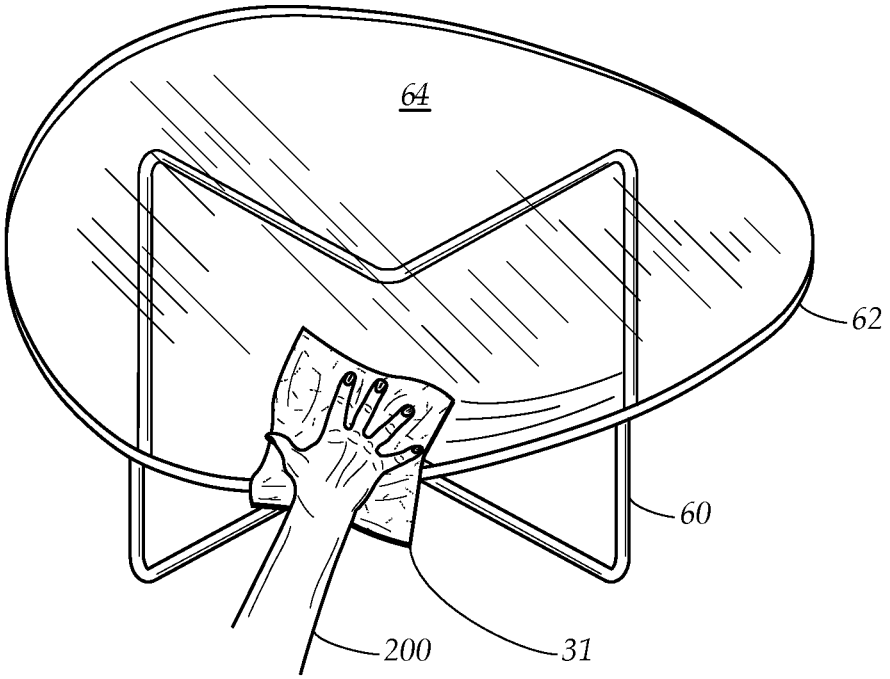
FIG. 2 illustrates wiping a cleaning surface using the first wipe, containing a first cleaning solution.

FIG. 2 illustrates a table 60 to be cleaned by a user 200. The table 60 illustrated has a glass tabletop 62, having a cleaning surface 64. Note that under normal conditions, the cleaning surface 64 has likely become soiled with dirt, grease, grime, and dust. Accordingly, to begin cleaning the cleaning surface 64, after opening the packet 10, the first wipe 31 is removed from the first chamber 101 of the packet 10 (as seen in FIG. 1). Returning now to FIG. 2, the user 200 proceeds by wiping the cleaning surface 60 thoroughly with the first wipe 31.

Figure 3A:
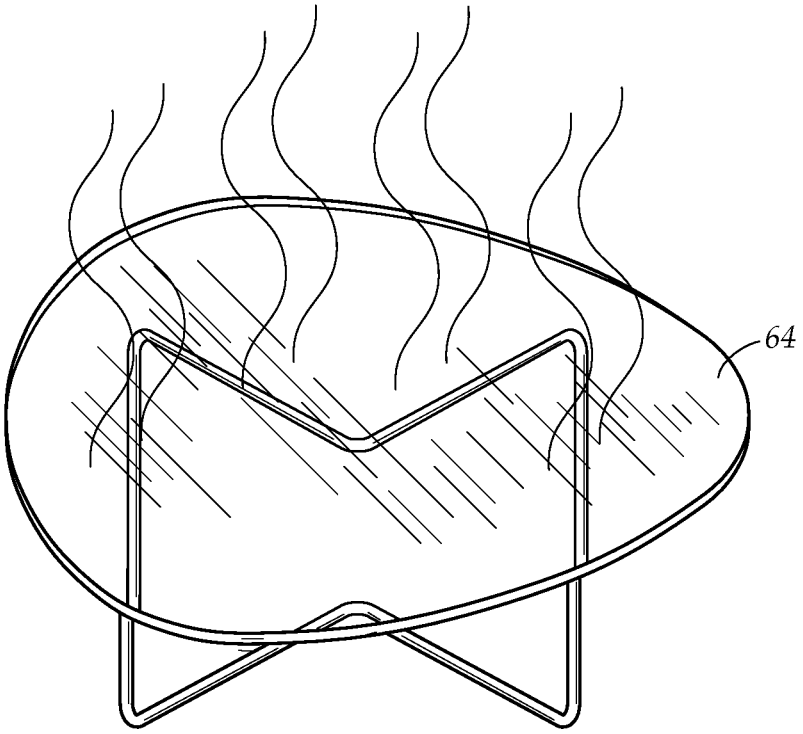
FIG. 3A illustrates one embodiment of a drying step, which occurs through the passage of time, wherein the first cleaning solution is allowed to fully evaporate from the cleaning surface.
Figure 3B:
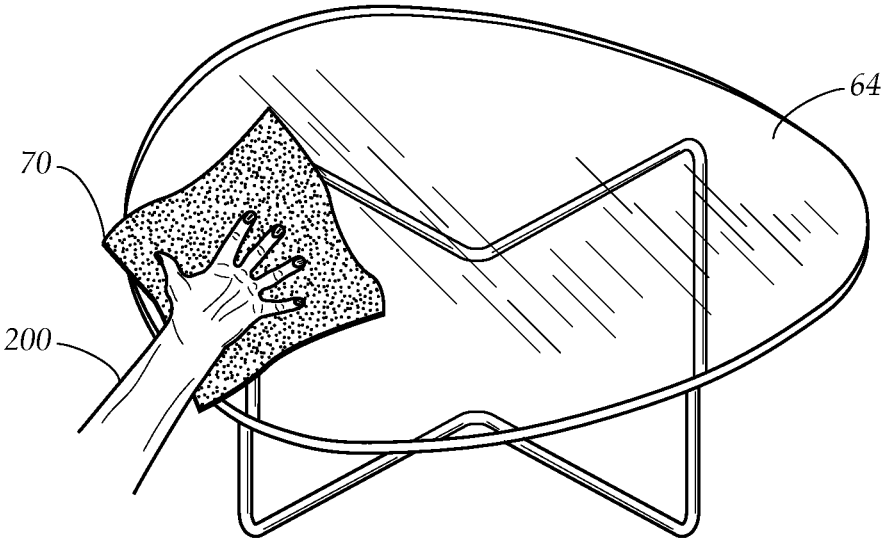
FIG. 3B illustrates another embodiment of the drying step, wherein an absorbent medium, such as a paper towel, is used to facilitate removal of the first cleaning solution from the cleaning surface.

After the first wipe is used, all traces of the first cleaning solution must be removed from the cleaning surface 64 to avoid mixing with the second cleaning solution. Generally removal of the first cleaning solution occurs by drying the cleaning surface 64. Drying the cleaning surface 64 may occur through evaporation, as illustrated in FIG. 3A. To facilitate more rapid completion of the overall cleaning process, the cleaning surface 64 is preferably dried using an absorbent medium 70, such as a dry paper towel shown being employed by in the user 200 to wipe the cleaning surface 64 in FIG. 3B. The cleaning surface is wiped repeatedly with the absorbent medium 70 until the first cleaning solution is removed. Note, at this point the cleaning surface 64 likely will show residue and streaks. Accordingly, merely cleaning with the first cleaning solution will not provide sufficient results, which is perhaps a significant reason why people of ordinary skill in the art of the invention would not typically use the first cleaning solution to clean a glass surface.

Figure 4:
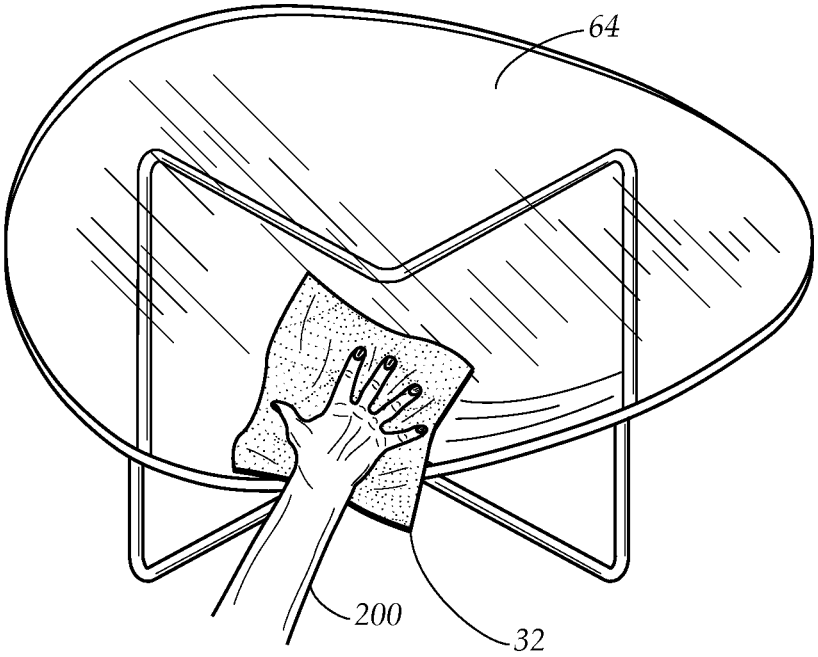
FIG. 4 illustrates wiping the cleaning surface using the second wipe, containing a second cleaning solution.

After the second wipe 32 is removed from the packet 10 (FIG. 1), the second wipe 32 is applied to the cleaning surface 64 (FIG. 4). In particular, the user 200 proceeds by wiping the cleaning surface 64 thoroughly using the second wipe 32.

Figure 5:
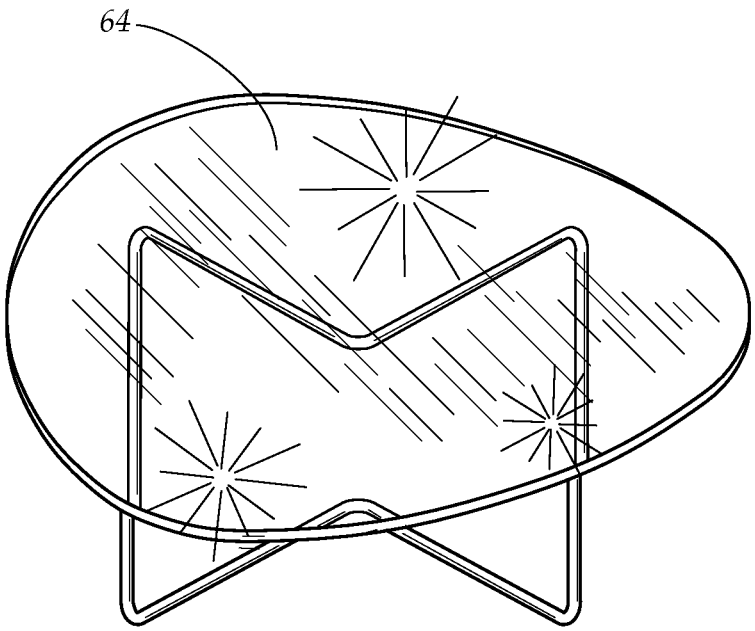
FIG. 5 illustrates the cleaning surface following use of of the second wipe, wherein the cleaning surface has an enhanced, glistening appearance, and has dirt repellant characteristics.

Following the application of the second cleaning solution, embedded in the second wipe 32, the cleaning surface 64 has a remarkable, glistening shine, that neither the first cleaning solution nor the second cleaning solution could provide alone, as seen in FIG. 5. The cleaning surface 64 also has dirt repellant properties, providing long lasting resistance to the accumulation of dirt and grime of all kinds, and to the attraction of dust.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a multi step cleaning system. The disclosure is illustrated by example in the drawing figures, and throughout the written description. It should be understood that numerous variations are possible, while adhering to the inventive concept. Such variations are contemplated as being a part of the present disclosure.

What is claimed is:

1. A cleaning process, for effectively cleaning a cleaning surface, using a first cleaning solution containing alkyl dimethyl benzyl ammonium chloride, a second cleaning solution containing acetic acid, comprising the steps of:

wiping the cleaning surface with the first cleaning solution;

fully drying the cleaning surface of the first cleaning solution; and then wiping the cleaning surface with the second cleaning solution.

2. The cleaning process as recited in claim 1, wherein the step of fully drying the cleaning surface further comprises manually drying the cleaning surface using an absorbent medium.

3. The cleaning process as recited in claim 2, wherein the steps as recited are preceded by a step of providing a first wipe that is impregnated with the first cleaning solution and providing a second wipe that is impregnated with the second cleaning solution; wherein the step of wiping the cleaning surface with the first cleaning solution further comprises wiping the cleaning surface with the first wipe; and wherein the step of wiping the cleaning surface with the second cleaning solution further comprises wiping the cleaning surface with the second wipe.

4. The cleaning process as recited in claim 3, wherein the first cleaning solution includes the alkyl dimethyl benzyl ammonium chloride at a substantially 0.25% concentration, and second cleaning solution includes the acetic acid at a substantially 0.75% to 2% concentration.

5. The cleaning process as recited in claim 4, wherein the cleaning surface is made of glass.

6. A cleaning process, for effectively cleaning a cleaning surface, the cleaning surface made of glass, using a first wipe having a cleaning solution containing alkyl dimethyl benzyl ammonium chloride, a second wipe having a second cleaning solution containing acetic acid, comprising the steps of:

wiping the cleaning surface with the first wipe;

fully drying the cleaning surface of the first cleaning solution with an absorbent medium; and then wiping the cleaning surface with the second wipe.

7. The cleaning process as recited in claim 6 wherein the steps as recited are preceded by a step of providing a packet having a first chamber and a second chamber that are isolated from each other, the first chamber containing the first wipe, and the second chamber containing the second wipe; wherein the step of wiping the cleaning surface with the first wipe is preceded by a step of removing the first wipe from the first chamber; and wherein the step of wiping the cleaning surface with the second wipe is preceded by a step of removing the second wipe from the second chamber.

8. The cleaning process as recited in claim 7, wherein the step of providing a packet having a first chamber and second chamber further comprises sealing the first wipe within the first chamber and sealing the second wipe in the second chamber.

9. The cleaning process as recited in claim 8, wherein the first cleaning solution includes the alkyl dimethyl benzyl ammonium chloride at a substantially 0.25% concentration, and second cleaning solution includes the acetic acid at a substantially 0.75% to 2% concentration.

10. The cleaning process as recited in claim 9, wherein the packet has a first outer wall, a second outer wall, a barrier wall between the first outer wall and second outer wall, and a periphery, and wherein the step of sealing the first wipe within the first chamber and sealing the second wipe in the second chamber further comprises creating a border region by sealing the first outer wall, second outer wall, and barrier wall together near the periphery; and wherein the steps of removing the first wipe from the first chamber and removing the second wipe from the second chamber is preceded by a step of tearing the border to open the first chamber and second chamber.

11. A cleaning process, for effectively cleaning a cleaning surface, the cleaning surface made of glass, using a first wipe having a cleaning solution containing alkyl dimethyl benzyl ammonium chloride, a second wipe having a second cleaning solution containing acetic acid, a packet having a first chamber and second chamber that are isolated from each other, the first wipe sealed in the first chamber, the second wipe sealed in the second chamber, comprising the steps of:

providing access to the first chamber and second chamber by opening the packet;

removing the first wipe from the packet;

wiping the cleaning surface with the first wipe;

fully drying the cleaning surface of the first cleaning solution; and then removing the second wipe from the packet; and wiping the cleaning surface with the second wipe.

12. The cleaning process as recited in claim 11, wherein the packet has a periphery, a first outer wall, a second outer wall, and a barrier wall between the first outer wall and second outer wall, a border region where the first outer wall, second outer wall, and barrier wall are sealed together near the periphery; wherein the step of opening the packet further comprises tearing the border to open the first chamber and second chamber.

13. The cleaning process as recited in claim 12, wherein the first cleaning solution includes the alkyl dimethyl benzyl ammonium chloride at a substantially 0.25% concentration, and second cleaning solution includes the acetic acid at a substantially 0.75% to 2% concentration.

14. The cleaning process as recited in claim 13, wherein the step of fully drying the cleaning surface further comprises manually drying the cleaning surface using an absorbent medium.

* * * * *